US006439931B1

(12) United States Patent
Niitsu et al.

(10) Patent No.: US 6,439,931 B1
(45) **Date of Patent: *Aug. 27, 2002**

(54) METHOD AND STRUCTURE FOR TUNING THE IMPEDANCE OF ELECTRICAL TERMINALS

(75) Inventors: Toshihiro Niitsu, Yokohama (JP); Stephen A. Sampson, Downers Grove, IL (US); Daniel Dawiedczyk, Lisle, IL (US); David L. Brunker, Naperville, IL (US); Augusto Panella, Naperville, IL (US); Michael Cheong, Naperville, IL (US)

(73) Assignee: Molex Incorporated, Lisle, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/078,054

(22) Filed: May 13, 1998

(51) Int. Cl.[7] ..... H01R 24/00
(52) U.S. Cl. ..... 439/660; 439/941
(58) Field of Search ..... 439/79, 80, 941, 439/660, 676

(56) References Cited

U.S. PATENT DOCUMENTS

| | | | | |
|---|---|---|---|---|
| 3,196,377 A | 7/1965 | Minich | ..... | 339/17 |
| 3,470,522 A | 9/1969 | Lawrence | ..... | 339/14 |
| 3,539,976 A | 11/1970 | Reynolds | ..... | 339/14 |
| 3,573,704 A | 4/1971 | Tarver | ..... | 339/14 |
| 4,461,522 A | 7/1984 | Bakermans et al. | ..... | 339/17 |
| 4,552,420 A | 11/1985 | Eigenbrode | ..... | 339/14 |

(List continued on next page.)

FOREIGN PATENT DOCUMENTS

| | | | |
|---|---|---|---|
| EP | 596313 A2 | 10/1993 | |
| EP | 651470 A2 | 10/1994 | |
| EP | 752741 A1 | 7/1996 | |
| JP | 1-206577 | 8/1989 | |
| JP | 5-205831 | 8/1993 | |
| JP | 6-36837 | 2/1994 | |
| JP | 7-58634 | 6/1995 | |
| JP | 7-161414 | 6/1995 | |
| WO | WO 89/03130 | 4/1989 | ..... H01R/13/40 |

*Primary Examiner*—Neil Abrams
(74) *Attorney, Agent, or Firm*—Thomas D. Paulius; Charles S. Cohen

(57) ABSTRACT

A method and structure of an electrical connector is provided for tuning the impedance of the terminals in the connector. The connector includes a dielectric housing having a plurality of terminal-receiving passages. A plurality of terminals are shaped from sheet metal material, with each terminal having a contact portion at one end and a terminating portion at an opposite end. The contact portion has a contact area which engages a mating terminal of a complementary mating connecting device. The contact portion, except for the contact thereof, or the tail portion, is selectively trimmed to a given size to vary the plate area of the contact portion or the tail portion to adjust the impedance of the terminal. This may be done by removing sections of the contact portion from the contact edges or by forming holes in the contact portions. Alternatively, to adjust impedance, a drive shoulder of the terminal may be located at a position to lengthen or shorten the contact portion or tail portion.

17 Claims, 7 Drawing Sheets

U.S. PATENT DOCUMENTS

| | | | | | |
|---|---|---|---|---|---|
| 4,687,267 | A | * | 8/1987 | Header et al. | 439/62 |
| 4,707,039 | A | | 11/1987 | Whipple | 439/75 |
| 4,878,849 | A | | 11/1989 | Talwar et al. | 439/79 |
| 4,886,474 | A | | 12/1989 | Drogo | 439/856 |
| 4,957,451 | A | | 9/1990 | Nadin | 439/395 |
| 4,996,766 | A | | 3/1991 | Piorunneck et al. | 29/842 |
| 5,004,430 | A | * | 4/1991 | Del Guidice et al. | 439/350 |
| 5,026,292 | A | | 6/1991 | Pickles et al. | 439/108 |
| 5,071,371 | A | | 12/1991 | Harwath et al. | 439/637 |
| 5,077,893 | A | | 1/1992 | Masquera et al. | 29/882 |
| 5,221,212 | A | | 6/1993 | Davis | 439/108 |
| 5,259,768 | A | | 11/1993 | Brunker et al. | 439/60 |
| 5,309,630 | A | | 5/1994 | Brunker et al. | 29/842 |
| 5,395,250 | A | | 3/1995 | Englert, Jr. et al. | 439/65 |
| 5,586,914 | A | * | 12/1996 | Foster, Jr. | 439/676 |

* cited by examiner

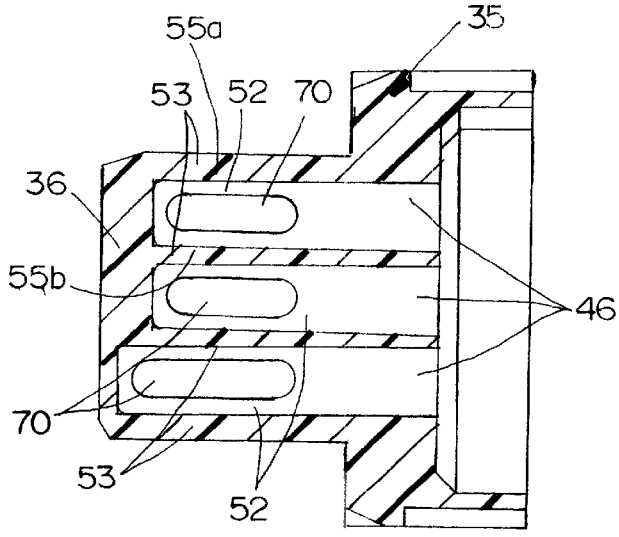
FIG.6
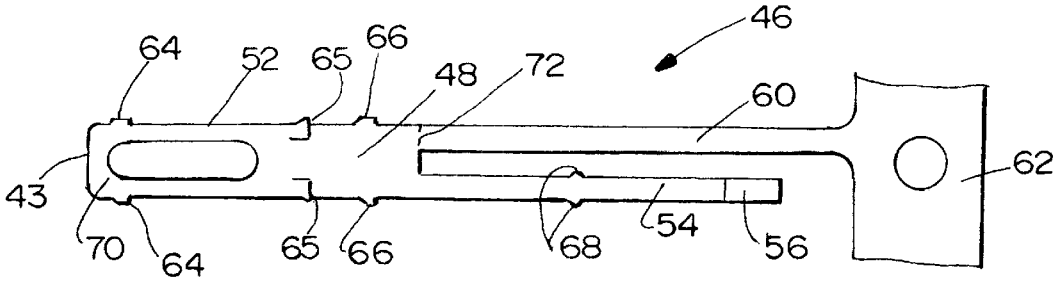
PRIOR ART FIG.7
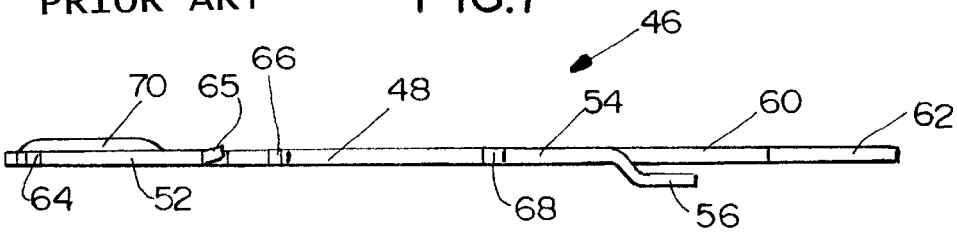
PRIOR ART FIG.8
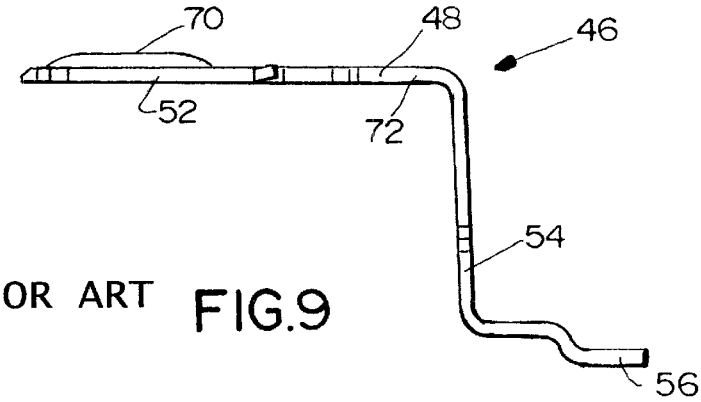
PRIOR ART FIG.9

METHOD AND STRUCTURE FOR TUNING THE IMPEDANCE OF ELECTRICAL TERMINALS

FIELD OF THE INVENTION

This invention generally relates to the art of electrical connectors and, particularly, to a method and structure for controlling the impedance in electrical connectors by controlling the impedance of the terminals of the connectors.

BACKGROUND OF THE INVENTION

In high speed electronic equipment, it is desirable that all components of an interconnection path be optimized for signal transmission characteristics, otherwise the integrity of the system will be impaired or degraded. Such characteristics include risetime degradation or system bandwidth, crosstalk, impedance control and propagation delay. Ideally, an electrical connector would have little or no effect on these characteristics of the interconnection system. In other words, the system would function as if circuitry ran through the interconnection without any effect on the system. However, such an ideal connector is impractical or impossible, and continuous efforts are made to develop electrical connectors which have as little effect on the system as possible.

Impedance and inductance control are concerns in designing an ideal connector. This is particularly true in electrical connectors for high speed electronic equipment, i.e., involving high frequencies. An example of one such connector is a board-mounted connector adapted for mounting on a printed circuit board and for mating with a complementary second connector. The connector includes a dielectric housing in which a plurality of terminals are mounted. Each terminal includes a contact portion, such as a contact blade, and a terminating portion, such as a terminal tail.

One exemplary obstacle to providing a consistent impedance across an electrical connection occurs when contact portions of terminals are mounted in a spaced-apart relationship in the dielectric housing of an electrical connector. The contact portions of terminals typically have a broad plate area relative to the rest of the terminal to assure adequate and reliable contact. The contact portions which are separated by a dielectric increase the capacitance of the terminals at the contact portions. Because impedance is inversely related to capacitance, the increase in capacitance causes an impedance drop in the terminals, thereby greatly disrupting the characteristic impedance through the overall electrical system.

This phenomena is illustrated in FIG. 22 in which impedance (Z) is plotted over distance along a terminal in a connector to provide an impedance curve for a conventional terminal. $Z_o$ is the average or characteristic impedance of the terminal over the distance of the terminal. The dip at $Z_{min}$ is the lowest impedance exhibited over the terminal at the contact portion. The greater the capacitance increase at the contact portion, the greater the impedance drop with respect to the characteristic impedance $Z_o$ and the greater the connector affects the electrical performance of the electrical system. Conversely, the peak at $Z_{max}$ represents the increased impedance of the tail portion at the end of the terminal which has a smaller plate area relative to the contact portion.

The invention is directed to a method and structure for tuning the impedance of an electrical connector, such as the connector described above, so as to adjust the impedance of the terminal and/or to minimize the range of deviation from the characteristic impedance of the system. The invention is specifically directed to tuning the connector by trimming or removing a section of the terminals of the connector.

SUMMARY OF THE INVENTION

An object, therefore, of the invention is to provide a new and improved method and structure for tuning the impedance of an electrical connector by selectively trimming a section of the terminals of the connector.

In the exemplary embodiment of the invention, generally, the connector includes a dielectric housing having a plurality of terminals mounted in the housing. Each terminal includes a contact portion at one end thereof and a terminating portion at an opposite end thereof. Each terminal has a contact area for mating to a respective terminal of a complementary connector to comprise a mated terminal pair.

The invention contemplates a method and structure in which a desired impedance is determined for each terminal in the connector. The contact area of the contact portion of each terminal is determined. The contact portion, except for the contact area thereof, is selectively trimmed to a given size to reduce the plate area of the contact portion according to the determination of the desired impedance of the terminals. By reducing the plate area of the contact portion, the capacitance at the contact portion of the terminal is reduced to increase the impedance $Z_{min}$ at the contact portion, thereby increasing the characteristic or average impedance $Z_o$ of the terminal. This procedure also has the result of diminishing the range of deviation of the impedance from the characteristic or average impedance $Z_o$ for the terminal. By increasing $Z_{min}$ , $Z_o$ is increased and brought closer to $Z_{max}$ which is determined by the terminal tail.

As disclosed herein, the contact area of the contact portion of each terminal is generally centrally located between side edges of the contact portion. All or part of the side edges may be trimmed to adjust the impedance or, alternatively, apertures or recesses may be formed in the contact portion on opposite sides of the contact area. Still further, the contact portion defines a front end of the terminal, and the front end may be trimmed to vary the impedance. Furthermore, a rear section of the contact portion may also be trimmed to vary the impedance. Preferably, the terminals are formed by stamping the terminals from sheet metal material, and the contact portions can be trimmed during the stamping operation.

The invention also contemplates selectively trimming the tail portion of the terminal to adjust the plate area of the tail portion. By reducing the plate area of the tail portion, the capacitance is decreased and the impedance $Z_{max}$ of the terminal at the tail portion is increased, and the deviation of the impedance at the contacting interface area is increased thereby increasing the characteristic impedance $Z_o$. By increasing the impedance $Z_{max}$ at the tail portion, relative to the characteristic impedance $Z_o$ and $Z_{min}$, the range of deviation between $Z_{max}$ and $Z_{min}$ is expanded.

This invention also contemplates adding plate area to the tail portion to adjust the impedance. By enlarging the plate area of the tail portion, the capacitance of the tail portion is increased and impedance $Z_{max}$ at the tail portion is decreased to decrease the characteristic impedance $Z_o$. By reducing the impedance $Z_{max}$ at the tail portion relative to $Z_o$ and $Z_{min}$, the range of deviation between $Z_{max}$ and $Z_{min}$ is contracted along the length of the terminal.

Another embodiment of the invention contemplates a terminal having a drive shoulder between the contact portion and the terminating portion of the terminal, to facilitate inserting the terminal into its respective terminal-receiving passage in the connector housing. The drive shoulder is selectively located at a given position longitudinally of the terminal to vary the relative plate areas of the contact portion and the terminating portion as necessary to achieve a desired impedance in the terminal and/or minimize the deviation of the impedance from the characteristic impedance of the electrical system.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 6 is a horizontal section taken generally along line 6—6 of FIG. 5;

FIG. 7 is a plan view of a conventional terminal for mounting in the connector of FIG. 1, still in an intermediate form and connected to a carrier strip during manufacture;

FIG. 8 is a side elevational view of the conventional terminal of FIG. 7;

FIG. 9 is a side elevational view of the conventional terminal of FIGS. 7 and 8, after the terminal is formed to its ultimate configuration;

DETAILED DESCRIPTION OF THE PREFERRED EMBODIMENTS

Figure 1:
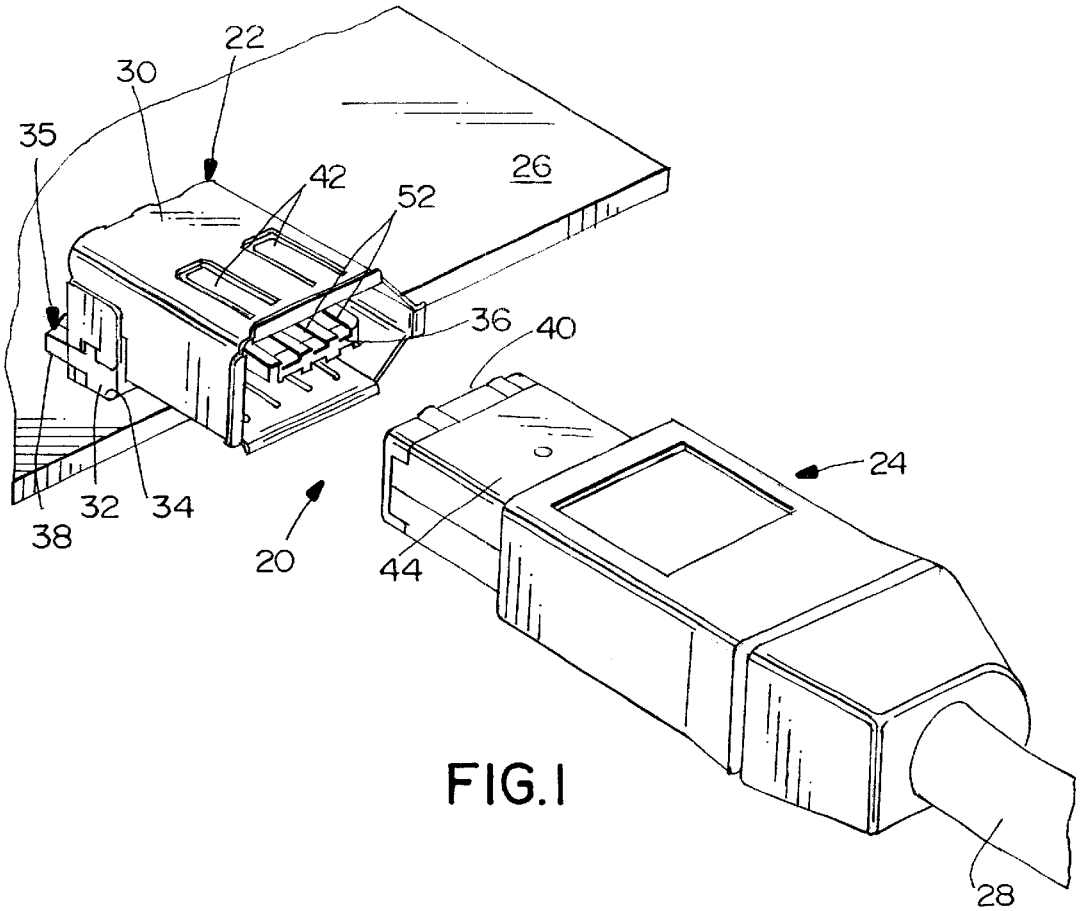
FIG. 1 is a perspective view of one type of electrical connector assembly with which the invention is applicable.
Figure 2:
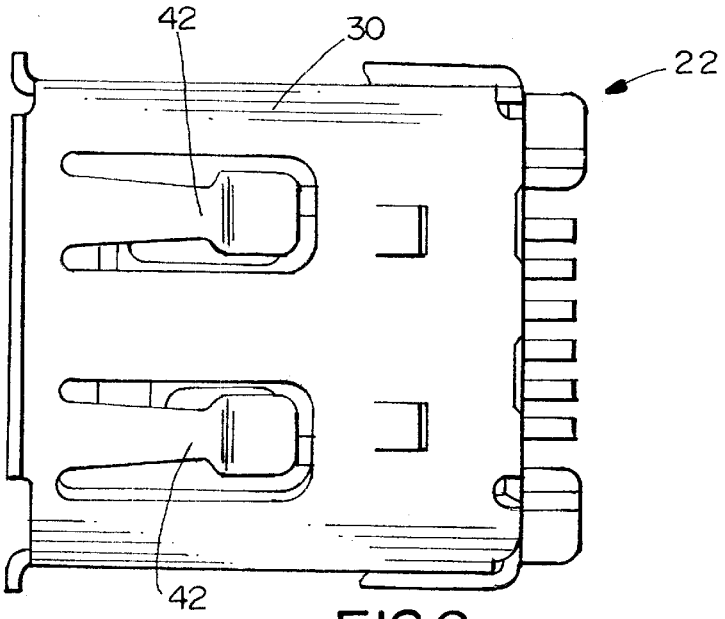
FIG. 2 is a top plan view of the board-mounted connector of the assembly in FIG. 1.
Figure 3:
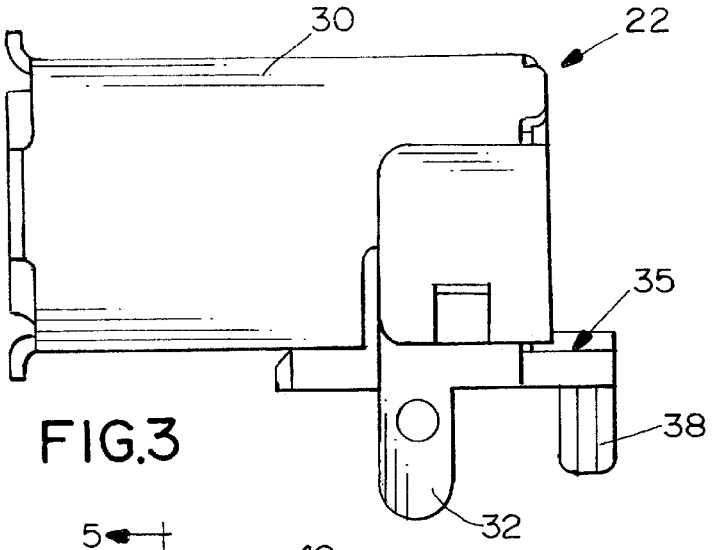
FIG. 3 is a side elevational view of the board-mounted connector.

Referring to the drawings in greater detail, and first to FIG. 1, the invention is embodied in an electrical connector assembly, generally designated 20, which includes a first or board-mounted connector, generally designated 22, and a second or mating connector, generally designated 24. Board-mounted connector 22 is mounted on the top surface of a printed circuit board 26, and mating connector 24 is terminated to a multi-conductor electrical cable 28. Mating connector 24 is a conventional connector and will not be described in detail herein except to state that the connector mounts a plurality of terminals 58 which are terminated to the conductors of cable 28 and which mate with the terminals of board-mounted connector 22. The terminals 52 shown in FIGS. 1–11 of the connector 22 are initially described as conventional terminals to highlight the invention.

Figure 4:
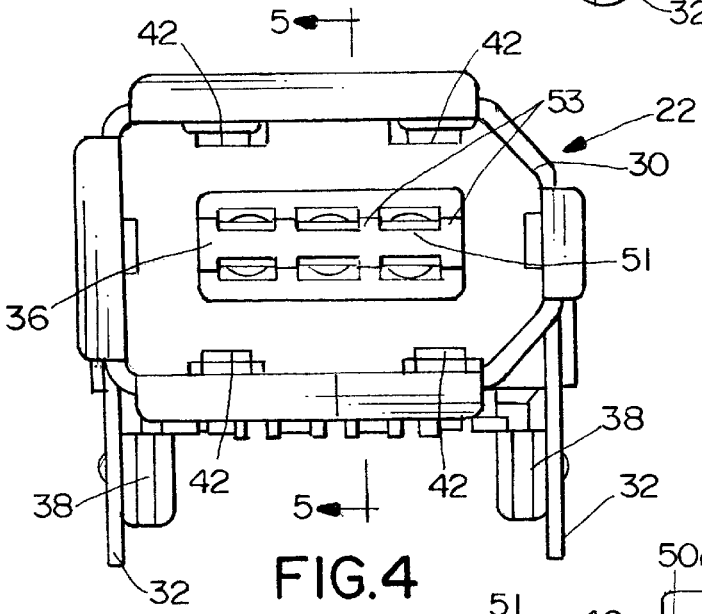
FIG. 4 is an end elevational view of the board-mounted connector, looking at the mating end thereof.
Figure 5:
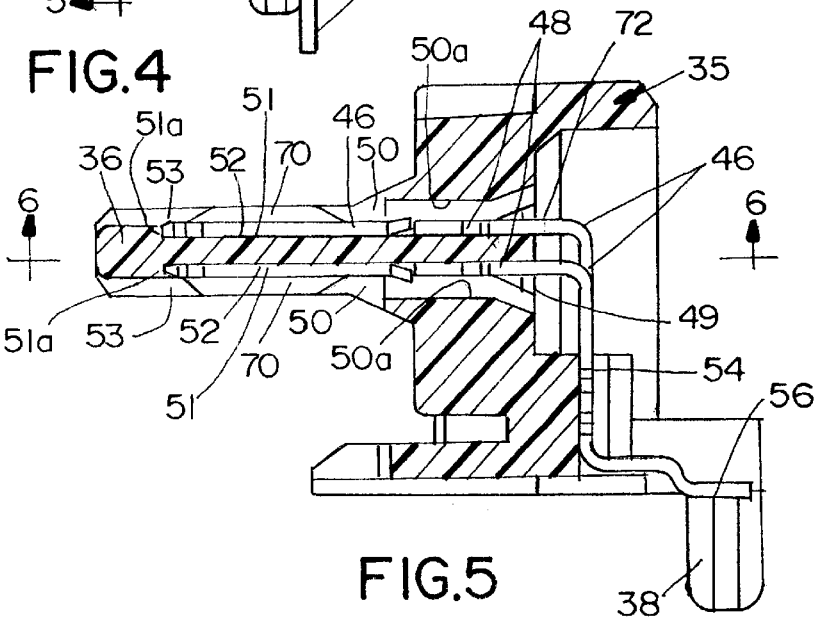
FIG. 5 is a vertical section, on an enlarged scale, taken generally along line 5—5 of FIG. 4 without the shield.

Referring to FIGS. 2–6 in conjunction with FIG. 1, board-mounted connector 22 is a shielded connector and includes an outer box-like shield 30 which is a one-piece structure stamped and formed of sheet metal material. The shield has integral feet portions 32 for insertion into appropriate holes 34 in the printed circuit board. The feet portions may be connected to appropriate ground traces on the printed circuit board. A dielectric housing or insert 35 is mounted within shield 30 and includes a forwardly projecting tongue or mating portion 36. As best seen in FIGS. 5 and 6, in which the housing 35 of board mounted connector 22 is shown without shield 30, a plurality of terminal-receiving passages 50 extend from a rear of the housing 35 to a front of the mating portion 36, both above and below the mating portion 36. At the rear of the housing 35 the passages 50 comprise a bore 50*a*. On the mating portion 36, the passages comprise a floor 51 bounded by lateral walls 53. The passages 50 are exposed between lateral walls 53 at the mating portion 36. A step 51*a* is provided in the floor 51 at a front end of the mating portion 36. The dielectric insert is unitarily molded of plastic material or the like and has a pair of board-mounting posts 38 for insertion into appropriate mounting holes in the printed circuit board.

The shield 30 is hollow for receiving a mating plug end 40 of second connector 24, and the plug end of the second connector has a socket for receiving forwardly projecting mating portion 36 of the dielectric insert of board-mounted connector 22. When the connectors are mated, a plurality of inwardly biased, cantilevered grounding arms 42 of shield 30 of board-mounting connector 22 make positive engagement with a circumferential shield 44 (FIG. 1) of mating connector 24.

The dielectric housing or insert 35 of board-mounted connector 22 is shown in FIGS. 5 and 6 without shield 30 to facilitate an illustration of the mounting of a plurality of terminals, generally designated 46, on the housing. The conventional terminals include contact portions 52 which are mounted in terminal-receiving passages 50 of the dielectric housing or insert 35. The contact portion 52 includes a body portion 48 disposed in the bore 50*a* to retain the terminal 46 in the passage 50. The contact ends or portions 52 are disposed in vertical alignment above and below the forwardly projecting mating portion 36 of the housing. Each conventional terminal includes a terminating end or tail portion 54 which projects out of a mouth 49 of the terminal-receiving passage at the rear of the housing, with the tail portion terminating in a foot 56 which is connected, such as by soldering, to an appropriate circuit trace on printed circuit board 26.

FIGS. 7 and 8 show one of the conventional terminals 46 in intermediate form after the terminal is stamped and partially formed from conductive sheet metal material, but with the terminal still connected by a web 60 to a carrier strip 62 during manufacture. It can be seen that contact portion 52 and tail portion 54 are stamped at opposite ends of the terminal 46 and the contact portion 52 is wider than the tail portion 54. The contact portion 52 includes a forward tip 43. Foot portion 56 at the distal end of tail portion 54 is offset from the tail portion during the stamping and forming operation, as seen in FIG. 8. Skiving teeth 64 for contact portion 52, teeth 65, 66 for body portion 48 and teeth 68 for tail portion 54 are formed during the stamping operation, for skiving into the plastic material of housing 35 to facilitate securing the terminal and its respective portions in the housing. Teeth 64, 65 and 66 skive into lateral walls 53 of terminal passages 50. Teeth 65 are cut on two edges from body portion 48 and are upwardly deformed. Upon insertion of the terminal 46 into terminal passages 50, teeth deflect to provide additional retention. First and second lateral edges 55*a* and 55*b* of terminals 46 are disposed at lateral walls 53 when mounted in terminal passages 50. Although the terminals 46 are described herein to be mounted in the housing 35 by insertion into terminal passageways, the terminals 46 of the present invention may be mounted in the housing 35 or a housing of a different connector to which the invention is applicable by insert-molding.

At this point, it should be noted that contact portion 52 of each conventional terminal 46 has an elongated raised boss 70 formed during the stamping and forming operation of the terminal. This raised boss defines the contact area of the contact portion which engages a complementary contact of one of the terminals mounted in mating connector 24. These raised bosses are effective to increase the positive forces of engagement between the mating terminals of the respective connectors and enhance the rigidity of the terminal. However, it should be understood that the invention is applicable for other types of terminals which may not include such raised bosses, but which have defined and determinable contact areas which, preferably, should not be disturbed during trimming of the terminals.

FIG. 9 shows one of the conventional terminals 46 after the terminal has been stamped and formed as described above in relation to FIGS. 7 and 8, and with the terminal further formed for insertion into dielectric housing 35 (FIG. 5). In other words, the final shape of the terminal in FIG. 9 corresponds to that shown in FIG. 5. Either before or after the terminal is so formed, web 60 and carrier strip 62 (FIG. 7) are severed from the terminal along line 72 (FIG. 7). Therefore, a drive shoulder is formed at line 72 to facilitate insertion of the terminal into its respective terminal-receiving passage in housing 35.

Figure 10:
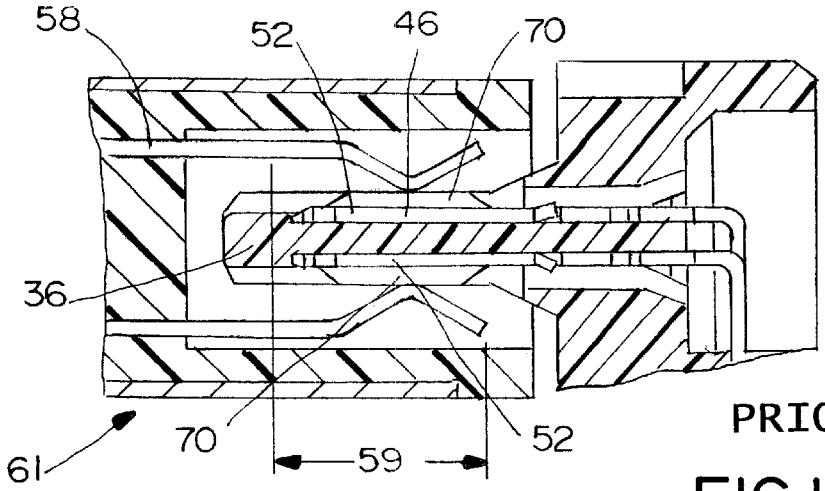
PRIOR ART FIG.10
FIG. 10 is an enlarged sectional view of the terminal of FIG. 7 mated with the terminal of the complementary connector of FIG. 1.
Figure 22:
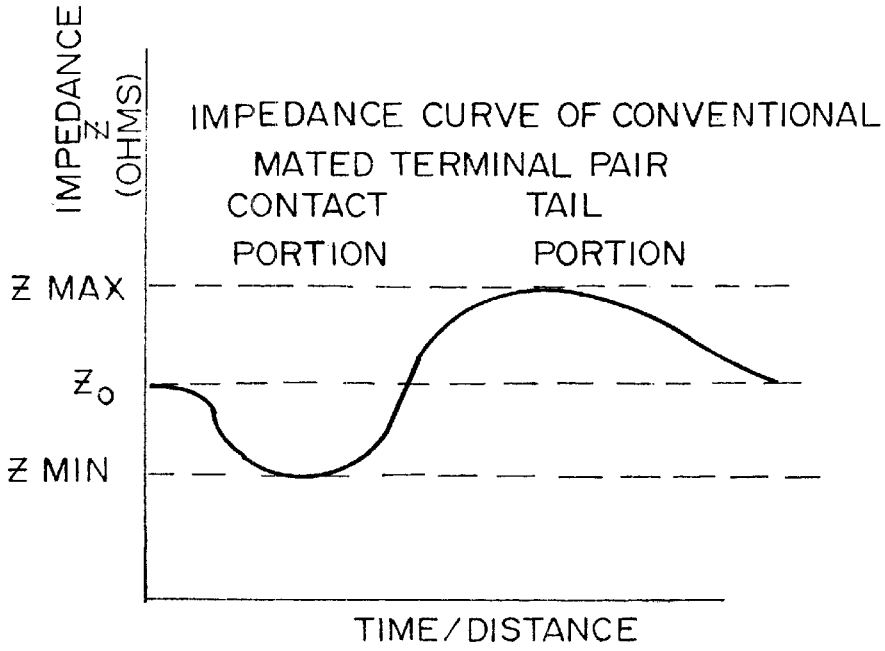
FIG. 22 is a graph plotting impedance as a function of time or distance of a terminal.

FIG. 10 shows a contacting interface area 59 at which contact portions 52 of conventional terminals 46 mate with terminals 58 of the complementary mating connector 24. The mating of terminal 46 and terminal 58 comprise a completed mated terminal pair 61. FIG. 4 illustrates that the terminals 46 are mounted on the top surface of the insert 35 and the terminals 46 are mounted on the bottom surface of the insert 35. Contact portions 52 of pairs of terminals 46 oppose each other on top and bottom surfaces of the insert 35. Because the pairs of contact portions 52 have relatively large plate areas opposed to each other in close proximity and are separated by a dielectric they increase the capacitance of the terminals 46 at the contact portions 52. The increased capacitance results in an impedance drop from the average impedance of the terminal 46 which increases the range of deviation of impedance across the terminal. This phenomena is shown in the impedance curve in FIG. 22 wherein the dip at $Z_{min}$ represents the impedance at the contact portion 52. Conversely, the tail portion 54 has relatively small plate area of metal opposed to an adjacent tail portion 54 and a greater inductance and, therefore, a greater impedance, represented by the hump at $Z_{max}$.

Figure 11:
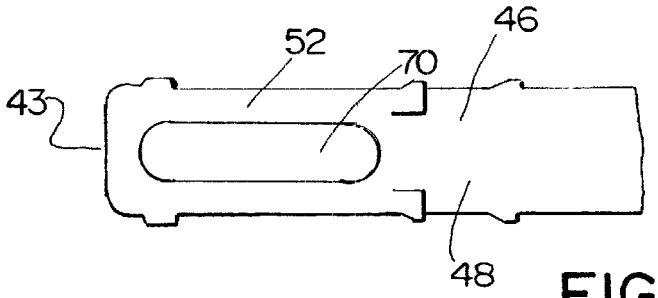
FIG.11 PRIOR ART
FIG. 11 is a fragmented plan view of the contact portion of the conventional terminal.

FIG. 11 shows a conventional contact portion 52, including a contact area 70, without any trimming and corresponding to the depiction of FIG. 7. FIGS. 12–20 show terminals of the present invention which have a similar configuration as the conventional terminal 46 but further modified to adjust the impedance across the contact portion 52 in accordance with the present invention. FIGS. 12–16 show various schemes for trimming contact portions 52*a*–52*e* of the terminals to effectively reduce the plate area of the contact portions to achieve a desired impedance across the contact portion or to minimize the impedance drop at the contact portion 52. The portions removed are shown in phantom in the Figures.

Figure 12:
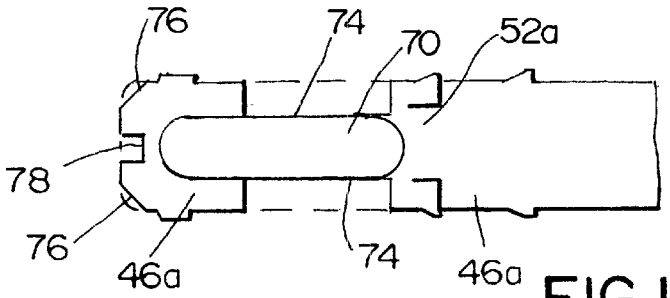
FIG. 12 is a fragmented plan view of a terminal for mounting in the connector of FIG. 1, with the contact portion selectively trimmed to a particular configuration in accordance with one embodiment of the present invention.

FIG. 12 shows one scheme for reducing the plate area of the contact portion 52*a* to reduce the capacitance and increase the impedance at the contact portion 52*a*. Specifically, side sections 74 of contact portion 52*a* of terminal 46*a* have been removed all the way to the contact area 70. In addition, corner sections 76 at the distal or insertion end of the contact portion have been removed. Still further, a central section 78 has been removed at the distal end of the contact portion. As a result, a significant area of contact portion 52*a* has been removed or trimmed away to significantly reduce the overall plate area of the contact portion 52. It should be noted that contact area 70 which engages the mating terminal is undisturbed. Metal may be removed as necessary to obtain a desired impedance at the contact portion 52*a* while preserving adequate provision for mechanical functions such as terminal retention, contacting engagement and robustness. Some of these considerations may not be as important if the terminals 46 are insert-molded in the housing 35. Additionally, the hump in the contact area 70 lends robustness to the terminal 26 and enhances the interengagement of the contact with the mating terminal 58. It is contemplated that these sections 74, 76, 78 will be removed from the contact portion 52 during the initial stamping process. However, the removal of these sections 74, 76, 78 may be performed later in the construction of the terminal.

Figure 13:
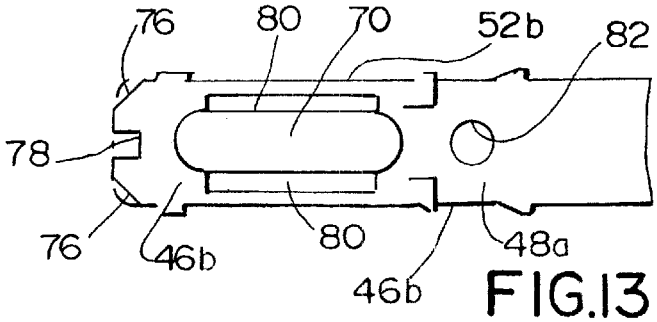
FIG. 13 is a fragmented plan view of a terminal for mounting in the connector of FIG. 1 with the contact portion trimmed to an alternative configuration in accordance with an alternative embodiment of the present invention.

FIG. 13 shows another scheme of trimming contact portion 52*b* by again removing corner sections 76 and central section 78 at the distal end of the contact portion. However, elongated holes 80 have been stamped out of the contact portion on opposite sides of contact area 70, and a round hole 82 has been stamped out of the body portion 48 at the inner end of contact area 70 of terminal 46*b*. Again, the result is the removal of significant metal plate area from the contact portion 52*b* to reduce the capacitance and, thereby, to increase the impedance of the terminals 46*b* at the contact portions 52*b*.

It should be noted that it is not necessary to remove metal from both sides of the contact area 70, so that the terminal 46 remains longitudinally symmetrical. Sections of the contact portion 52 may be selectively removed from only one side of the contact area 70 to obtain desired electrical characteristics with respect to adjacent mated terminal pairs.

Figure 14:
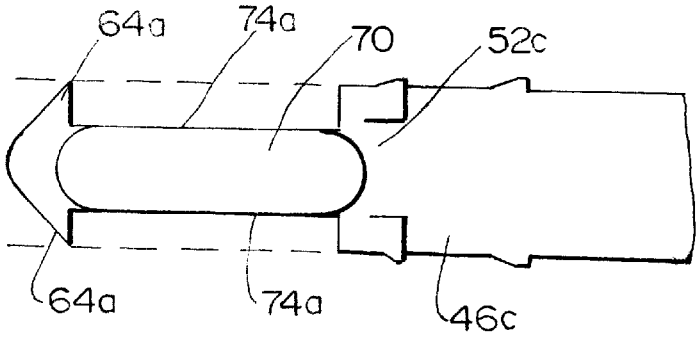
FIG. 14 is a fragmented plan view of a terminal for mounting in the connector of FIG. 1 with entire side edges of the contact portion trimmed in accordance with an additional embodiment of the present invention.

FIG. 14 shows an additional scheme for reducing the area of terminal 46*c*. Side sections 74*a* of the contact portion 52*c* have been removed all the way to the front end of the terminal 46*c*. Skiving teeth 64*a* are disposed on the narrowed front end of the contact portion 52*c*.

Figure 15:
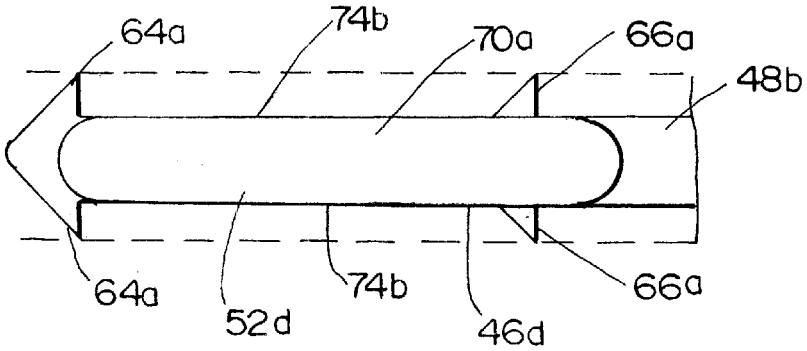
FIG. 15 is a fragmented plan view of a terminal for mounting in the connector of FIG. 1 with entire side edges of the contact portion trimmed in accordance with an additional embodiment of the present invention.

FIG. 15 shows a further scheme for reducing the area of terminal 46*d*. Side sections 74*b* of the entire contact portion 52*d* and the body portion 48*b* have been removed. The elongated raised boss 70*a* of the contact area is lengthened to provide additional structural rigidity to the thinner terminal 46*d*. In addition to skiving teeth 64*a* disposed on the front end of the narrowed contact portions 52*d*, skiving teeth 66*a* are also disposed on the narrowed contact portion 46*d*.

Figure 16:
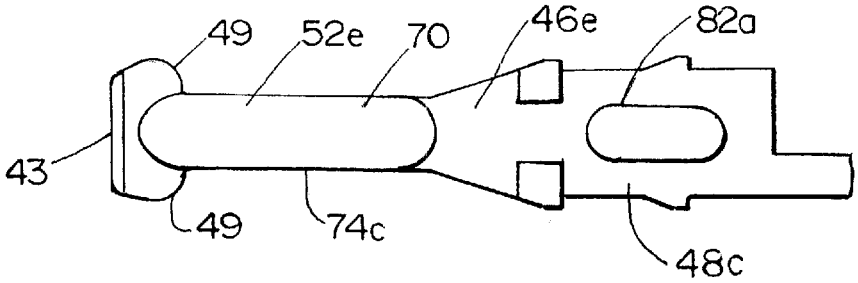
FIG. 16 is a fragmented plan view of a terminal for mounting in the connector of FIG. 1 with the contact portion selectively trimmed to a particular configuration in accordance with a further embodiment of the present invention.

FIG. 16 shows a further scheme for reducing the area of the terminal 46*e*. Side sections 74*c* of contact portion 52*e* have been removed to define opposite, side recessed sections 74*c* bounded by front and rear edges. The rear edges rearwardly diverge at angles on opposite sides of the terminal 46*e*. Moreover, elongated hole 82*a* is fashioned in body portion 48*c*. It may be preferable to trim sections to have radiused corners 49 as shown in FIG. 16 to reduce electromagnetic field concentration points.

When the terminals 46*a*–46*e* are mounted in terminal cavities, the first edge 55*a* of the terminal 46 is disposed at the first lateral wall 53 of the cavity 50 and the second edge 55*b* of the terminal 46 is disposed at the second lateral wall 53 of the cavity 50. A gap in the contact portions 52*a*–52*e* of terminals 46*a*–46*e* is provided between an edge of the terminal at the boundary of the recessed section and the adjacent first and second lateral walls to expose a portion of the floor 51 of the terminal cavity 50 where a section of the contact portion 52*a*–52*e* has been trimmed away.

Figure 17:
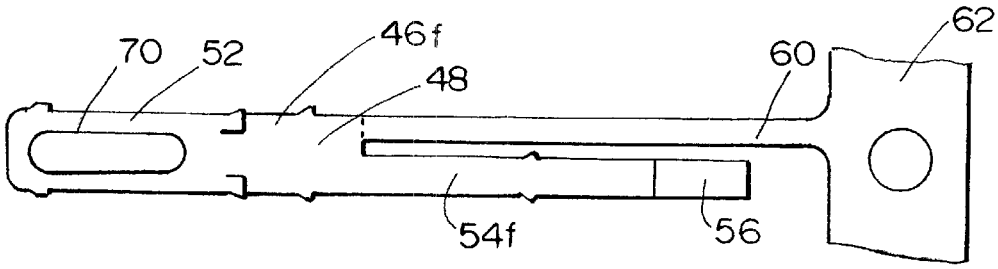
FIG. 17 is a plan view of a terminal for mounting on the connector of FIG. 1, but with a wider tail portion than that of the conventional terminal of FIG. 7.
Figure 18:
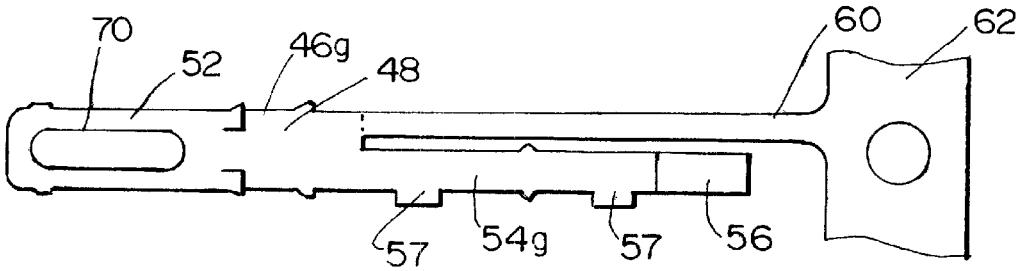
FIG. 18 is a plan view of a terminal for mounting on the connector in FIG. 1, but with sections added to the tail portion.

FIGS. 17–20 show another scheme for varying the impedance of terminals 46*f*–46*i*. In FIG. 17, tail portion 54*f* of the terminal 46*f* has been made wider than tail portion 54 shown in FIG. 7. Increasing the tail width decreases the impedance of the terminal and also reduces the extent of the impedance deviation from the contact portion 52. FIG. 18 shows an additional way to increase the plate area of the tail portion 54*g* in terminal 46*g* by adding sections 57 of metal to the edges thereof.

Figure 19:
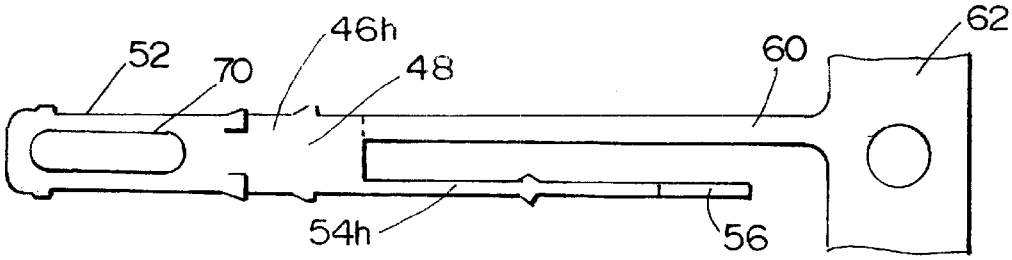
FIG. 19 is a plan view of a terminal for the mounting on the connector of FIG. 1, but with a more narrow tail portion than that of the terminal in FIG. 7.

Conversely, tail portion 54*h* of terminal 46*h* in FIG. 19 has been made more narrow than tail portion 54 in FIG. 7. Reducing the plate area of the tail portion increases the impedance of the terminal and will increase the deviation of the impedance from the characteristic impedance at the contact portion. By narrowing and widening the tail portions, the plate areas of the tail portions can be varied to correspondingly adjust the impedance of the terminals.

Figure 20:
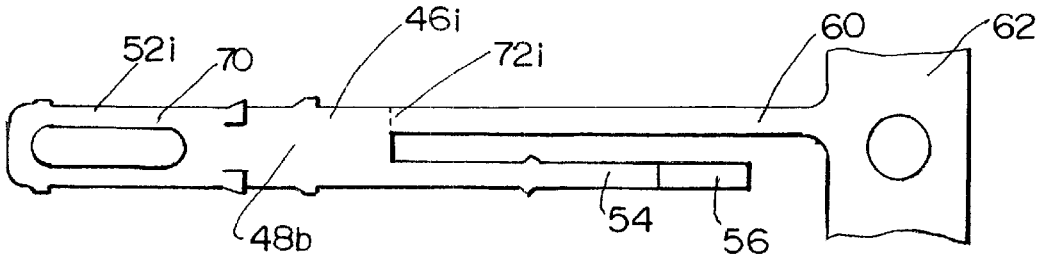
FIG. 20 is a plan view of a terminal for mounting on the connector in FIG. 7, but with the drive shoulder of the terminal at a different location than that of the terminal in FIG. 7.
Figure 21:
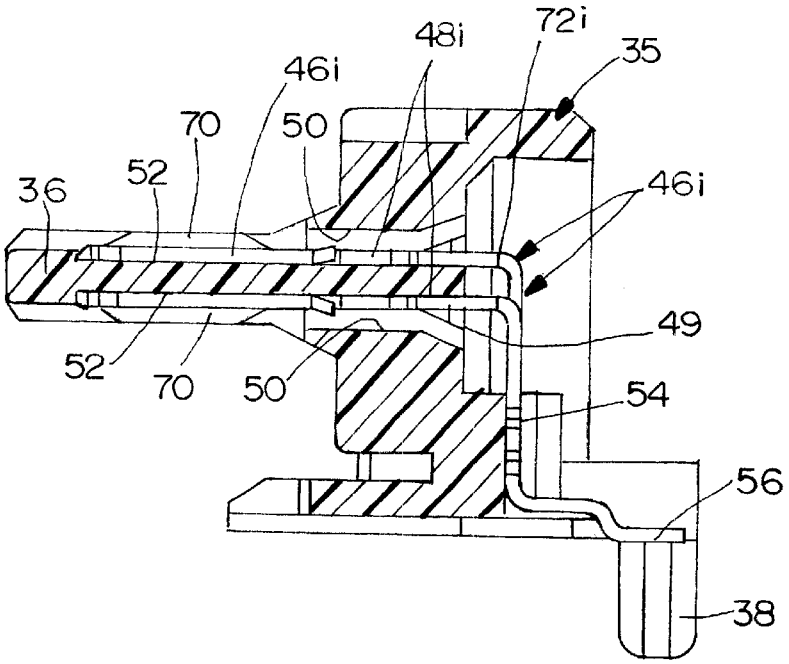
FIG. 21 is a vertical section view of the connector of FIG. 5 but mounting the terminal of FIG. 20.

Finally, FIG. 20 shows a terminal 46*i* in which the drive shoulder 72*i* has been moved rearwardly (to the right) versus the location of drive shoulder 72*i* in FIG. 7. This increases the plate area of the contact portion 52*i* at the body portion 48*i* which, in turn, again will decrease the impedance of the respective terminals. In other words, the axial location of drive shoulder 72*i* can be varied to, correspondingly, adjust the metal plate area of the contact portion and the plate area distribution of the terminal to adjust the impedance of the terminal and the deviation of the impedance at the contact portion 52. FIG. 21 shows terminal 46*i* mounted in the housing 35 with the drive shoulder 72*i* spaced remotely from the mouth 49 of the terminal-receiving passage 50 as compared to terminal 46 in FIG. 5.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A method of manufacturing an electrical connector to have a desired impedance, comprising the steps of:

providing a dielectric housing having a plurality of terminal-receiving passages for receiving a plurality of terminals, each of said terminals including a contact portion at a front end of said terminal and a tail portion at an opposite end of said terminal, said contact portion being larger than said tail portion defining a drive shoulder therebetween to facilitate inserting said terminals into respective ones of said terminal-receiving passages;

determining a desired impedance for each of a plurality of terminals;

shaping said plurality of terminals from sheet metal material;

selectively locating said drive shoulder at a given position to vary the relative plate areas of said contact portion and said tail portion to achieve the desired impedance of the terminals; and inserting the terminals into the terminal-receiving passages of the housing;

whereby each of said terminals provides the desired impedance along the length of each of said terminals.

2. An electrical connector comprising:

an insulative housing having a plurality of terminal-receiving passages; and, a plurality of terminals formed from a single thickness of metal mounted in the terminal-receiving passages, each of the terminals being formed from a single thickness of conductive material and including a contact portion for contacting an opposing terminal of a mating connector and a terminating portion for termination to a circuit board, the contact portion including a body portion interconnecting the contact portion and the terminating portion together, the contact portion being formed with distinct housing and terminal engagement areas, the contact portion housing engagement area of said terminal extending in a single horizontal plane and engaging a terminal-receiving passage of said connector housing, the contact portion terminal engagement area of said terminal extending out of said horizontal plane to thereby present a raised terminal engagement surface of said terminal for engaging an opposing terminal of the mating connector, said terminal further including at least one notch formed in said housing engagement area and extending in said single plane, the one notch being disposed adjacent said contact portion terminal engagement area of said terminal, said notch affecting a capacitance of said terminal to thereby adjust the overall impedance of said connector along said contact portion of said terminal.

3. The electrical connector of claim 2, wherein each of said terminals includes an opening formed in a front end of said terminal in said contact portion housing engagement area.

4. The electrical connector of claim 2, further including a second notch formed in said contact portion housing engagement area of said terminal adjacent said contact portion terminal engagement area, the second notch being spaced apart from said first notch by said contact portion terminal engagement area.

5. The electrical connector of claim 4, wherein said first and second notches open outwardly on respective opposite sides of said terminal.

6. The electrical connector of claim 4, wherein said first and second notches flank said contact portion terminal engagement area of said terminal and within opposing side edges of said terminal.

7. The electrical connector of claim 2, wherein said raised terminal engagement surface includes an elongated, raised boss.

8. The electrical connector of claim 2, further including a pair of skiving teeth disposed on opposite sides of said terminal proximate to a front end of said terminal.

9. The electrical connector of claim 8, further including a second pair of skiving teeth disposed on opposite sides of said contact area housing engagement area of said terminal, said second pair of skiving teeth being spaced from said first pair of skiving teeth lengthwise of said terminal.

10. The electrical connector of claim 4, wherein said terminal further includes a pair of radiused corners formed in said contact portion housing engagement of said terminal area adjacent to said first and second notches, the radiused corners being disposed on opposite sides of said contact portion terminal engagement area of said terminal, and said terminal body portion diverging outwardly and rearwardly from said contact portion terminal engagement area of said terminal.

11. The electrical connector of claim 2, wherein said terminating portion includes a tab extending laterally from a side edge thereof to affect the capacitance of the terminal to thereby additionally adjust the overall impedance of the connector.

12. An electrical connector having a preselected impedance, comprising:

a connector housing formed from an insulative material, the housing including a plurality of terminal supporting slots; and, a plurality of terminals formed from a single thickness of conductive material, the terminals being supported by the connector housing, a single terminal being supported by a single terminal supporting slot, each of said terminals including a contact portion for contacting an opposing terminal of a mating connector, a tail portion for attachment to a circuit board, and a body portion interconnecting the contact and tail portions together, the contact portion having distinct first and second engagement surfaces disposed thereon, the first engagement surface extending in a plane and including means extending within the plane for engaging one of said terminal supporting passages, the second engagement surface extending out of and away from said plane to present a contact surface for contacting a corresponding opposing terminal of said mating connector, said terminal further including a first slot formed in said first engagement surface adjacent said second engagement surface and adjacent said terminal supporting passage engagement means, the first slot removing material from said first engagement surface to thereby affect the capacitance of said terminal to thereby adjust the overall impedance of said connector in said contact portion.

13. The electrical connector of claim 12, wherein the second engagement surface includes a raised boss.

14. The electrical connector of claim 13, wherein the raised boss extends lengthwise of said terminal.

15. The electrical connector of claim 12, wherein the second engagement surface is defined by a perimeter, and the second engagement surface perimeter is disposed between opposite sides of said terminal, and said first slot abuts said second engagement surface perimeter.

16. The electrical connector of claim 12, further including a second slot formed in said first engagement surface adjacent said second engagement surface, the second slot also being adjacent to said terminal supporting passage engagement means and also removing conductive material from said first engagement surface, said first and second slots being spaced apart from each other by said second engagement surface.

17. The electrical connector of claim 12, wherein said terminal supporting passage engagement means includes a pair of skiving teeth disposed proximate to a front end of said terminal on opposite sides of said terminal.

* * * * *